United States Patent [19]

Pitts, Jr. et al.

[11] 4,250,758

[45] Feb. 17, 1981

[54] COMBINATION FOR USE IN A ROTARY DRILLING SYSTEM WITH TORQUE METER

[75] Inventors: Robert W. Pitts, Jr.; Herbert A. Rundell; Theodore W. Nussbaum, all of Houston, Tex.

[73] Assignee: Texaco Inc., White Plains, N.Y.

[21] Appl. No.: 972,623

[22] Filed: Dec. 22, 1978

[51] Int. Cl.[3] ..... G01N 29/04

[52] U.S. Cl. ..... 73/650; 73/151

[58] Field of Search ..... 73/650, 151, 136 A, 73/660; 175/39, 40

[56] References Cited

U.S. PATENT DOCUMENTS

| | | | |
|---|---|---|---|
| Re. 28,436 | 6/1975 | Vitter et al. | 73/151 |
| 2,161,256 | 6/1939 | Karcher | 73/650 |
| 3,581,564 | 6/1971 | Young | 73/151 |
| 4,150,568 | 4/1979 | Berger et al. | 73/151 |

*Primary Examiner*—Anthony V. Ciarlante

*Attorney, Agent, or Firm*—Carl G. Ries; Robert A. Kulason; Henry C. Dearborn

[57] ABSTRACT

A system applicable to rotary drilling. It includes a torque meter that measures dynamic torque while drilling. The system averages the time period of individual oscillations in the torque, for a given number of such oscillations. It indicates the length of such average time numerically. Consequently, the probable cause of the oscillations may be inferred.

8 Claims, 3 Drawing Figures

COMBINATION FOR USE IN A ROTARY DRILLING SYSTEM WITH TORQUE METER

BACKGROUND OF THE INVENTION

1. Field of the Invention

This invention concerns rotary drilling systems, in general. More specifically, it deals with such a system that includes a torque meter for measuring dynamic torque while drilling, and it relates to a combination that provides a system for indicating the time period of oscillations in the torque that is being applied during drilling operations.

2. Description of the Prior Art

It has been recognized that during rotary drilling operations, the torque applied to the drill string sometimes builds up an oscillation that has particular characteristics. It has been noted that these variations in torque are related to torsional oscillations which take place in the drill string during the drilling operation. And, two dominant frequencies have been consistently observed in output signals from a dynamic torque meter. The period of these signal variations are about 3 and 8 seconds. Heretofore, a U.S. Pat. No. 3,703,096, Nov. 21, 1972, which was reissued as U.S. Pat. No. RE. 28,436 to Vitter, Jr., et al on June 3, 1975, has suggested a system for recording the torque variations during a drilling procedure. However, that arrangement required the observation of the record thus made, and such observation had to include a reading of such record in order to make the determination as to length of time for any torque oscillations which took place.

On the other hand, the applicants' invention provides a system that has the means for direct reading, in numerical results, the time duration of an average oscillation as it occurs.

SUMMARY OF THE INVENTION

Briefly, the invention concerns a combination that is applicable to a rotary drilling system, including a torque meter for measuring dynamic torque while drilling. The combination comprises first circuit means for detecting oscillations in said dynamic torque, and second circuit means for timing said oscillations. It also comprises means for indicating the time period of said oscillations in order to provide a display which indicates the cause of said oscillations.

Again briefly, the invention concerns a combination applicable to a rotary drilling system which includes a torque meter for measuring dynamic torque while drilling. The combination comprises a low pass filter passing up to 1.0 hertz, and a zero crossing detector for indicating oscillations in said dynamic torque. It also comprises a divide by ten counter for dividing the number of outputs from said zero crossing detector, in order to average the time period of ten of said oscillations. And, it comprises means for producing periodic timing pulses at one second intervals. It also comprises a pair of binary coded decimal counters for counting by units and tens the number of said one second pulses between outputs from said divide by ten counter, and a pair of seven-segment display means for said units and tens' counter. It also comprises circuit means including latches for actuating said display means when said number of one second pulses occurring between outputs from said divide by ten counter, has averaged the said ten oscillations.

BRIEF DESCRIPTION OF THE DRAWINGS

The foregoing and other objects and benefits of the invention will be more fully set forth below in conjunction with the best mode contemplated by the inventors of carrying out the invention, and in connection with which there are illustrations provided in the drawings, wherein:

FIG. 3 is a more detailed circuit diagram illustrating the system as shown in FIG. 2.

DESCRIPTION OF THE PREFERRED EMBODIMENT

Figures 1, 2:
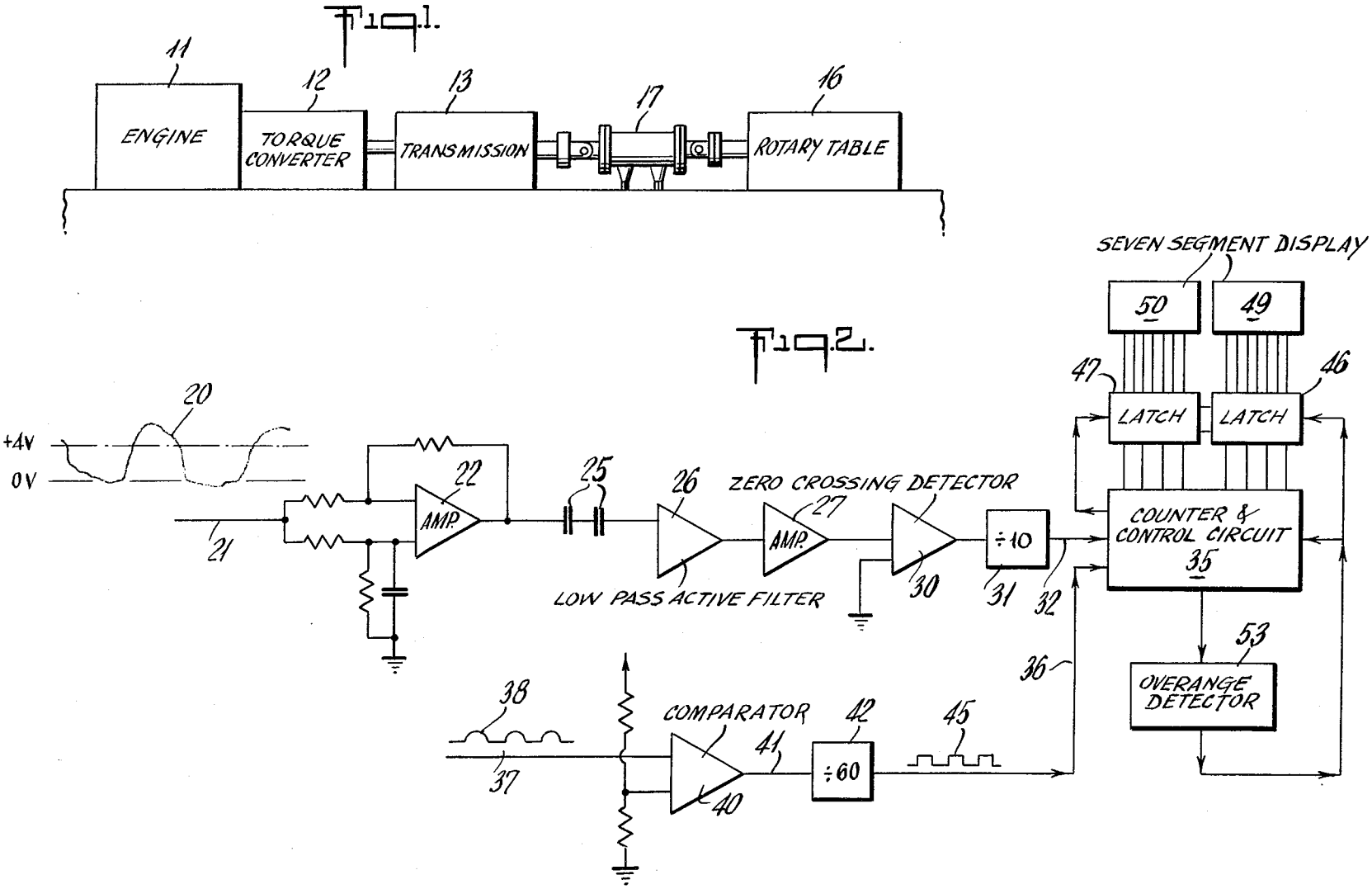
FIG. 1 is a schematic illustration, indicating a rotary drilling arrangement including a torque meter for providing dynamic torque signals to be employed in a system according to the invention.
FIG. 2 is a schematic circuit diagram partially in block diagram form, illustrating a system according to the invention.
Figure 2:
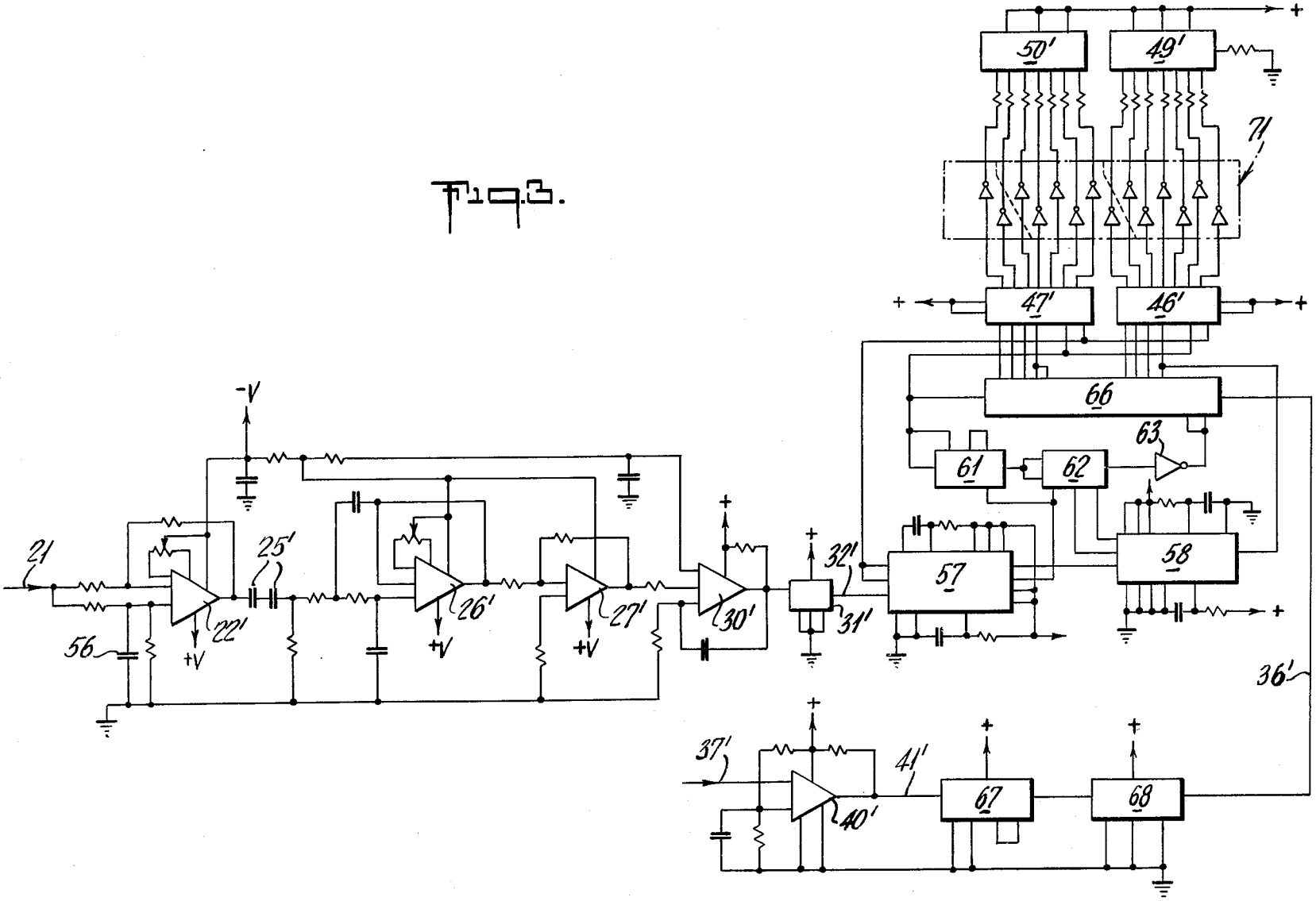

With reference to FIG. 1, it will be noted that a system according to this invention is particularly applicable to a rotary drilling arrangement such as that which is illustrated schematically as a typical system. Thus, a rotary drilling arrangement includes an engine 11 connected to a torque converter 12 that drives a transmission 13. Between the transmission 13 and a rotary table 16 there is a torque meter 17 that measures the torque dynamically as it is being applied during drilling.

The torque meter 17 might take various forms so long as it can supply a signal in accordance with the dynamic torque being applied, i.e. from the power source to the rotary table of a drilling operation. Preferably, however, it is like the torque meter illustrated and described in U.S. Pat. No. 3,295,367, H. A. Rundell, Jan. 3, 1967. Thus, the output signal from the torque meter 17 is a DC voltage which varies dynamically in accordance with the torque being measured.

FIG. 2 illustrates, in block circuit diagram form, a system according to the invention. It will be observed that the torque signal is in the form of a DC signal that varies dynamically as the torque changes during the rotary drilling operation. It may take the form illustrated by an AC wave 20 that is developed when the torque which is being applied is oscillatory in nature. Such a signal, e.g. the wave 20, is being applied to an input circuit connection 21. This input circuit goes to an amplifier 22 which has an output connected via a pair of capacitors 25 to a low pass active filter 26. Filter 26 is designed to pass only oscillations having a frequency up to 1.0 hertz, in order that the expected oscillations of either about 3 or about 8 seconds per cycle may be passed while excluding any other frequency oscillatory signals. The output of the filter 26 goes via an amplifier 27 to a zero crossing detector 30. The output of the zero crossing detector 30 goes to a divide by ten counter 31 that provides an output signal on a circuit connection 32, every tenth input from the zero crossing detector 30. Then, by timing the duration of the period between output signals from the divide by ten counter 31, there is an average time measured relative to the ten input signals that have occurred between the outputs from the counter 31.

In order to carry out the timing mentioned above, there is a counter and control circuit 35, which is indicated by the caption. This acts to count the number of timing pulses received over an input circuit 36 during the output signals indicated above which are coming from the zero crossing detector 31. While these timing pulses could, of course, be developed from any predetermined time base, it is preferable to employ an arrangement like that illustrated which produces pulses at one second intervals. Such pulse signals are accomplished by having an input circuit connection 37 which has a rectified 60 cycle signal (indicated by wave form 38) impressed thereon. Consequently, a comparator 40 may pass output pulses which are above a predetermined amplitude, onto an output circuit connection 41. These pulses go into a divide-by-60 counter 42 so that the output is a series of pulses as indicated by the square wave pulse symbol 45. These are spaced at one second intervals.

The counter and control circuit 35 acts to count the number of one second pulses coming in over the circuit connection 36, and it provides a pair of binary coded decimal outputs. These outputs go into two latches 46 and 47 which are indicated and which accept the units and tens counts, respectively. These latches transform each count into the corresponding seven segment coding thereof, for actuating each of a pair of seven segment display elements 49 and 50.

The operation is such that the timing between outputs of the divide-by-ten counter 31 is measured in seconds and tens of seconds, and consequently the indications provided at the ending of each interval represent the time measured for ten of the oscillations that have created zero crossing signals from the detector 30. Therefore, one tenth of this time interval represents the average time for each of the ten zero crossing outputs. Thus, the seven segment display elements 49 and 50 together represent the length of an average oscillation for the ten oscillations. This being measured in terms of seconds and tenths of a second.

Since the oscillations of interest are only those less than 1.0 cycles per second, i.e. 1.0 hertz, the system is provided with an overrange detector 53. This will act to reset the counters and start everything over at the next output from the divide by ten counter 31, if the count of one second pulses exceeds 99. This would mean that the average oscillation is longer than 10 seconds, and consequently the overrange detector will take over and reset the counter so as to maintain the action within the range of the low pass filter 26.

OPERATION

While the more detailed circuit diagram will be described hereafter, the operation of the system may be understood by reviewing a hypothetical example in relation to the FIG. 2 system which was described above. Let it be assumed that there are oscillations in the torque signal occurring at a frequency of about 3 seconds per cycle, and that the wave form of such oscillations is like that illustrated by the wave 20 indicated in FIG. 2. Then, after a tenth oscillation signal has occurred, the zero crossing detector 30 will have provided a tenth output signal into the divide by ten counter 31. Therefore there will be an output signal on the circuit connection 32 into the counter and control circuit 35. Such signal will act to reset the counters that are supplying the latches 46 and 47, so that they will then read 0.0.

Following the foregoing reset, the counters will commence counting the one second pulses (i.e. square wave signals 45) which are being applied on the input circuit 36. This count will continue until the next output signal from the divide by ten counter 31. And, consequently, the count will have reached about 3.0 on the counters because thirty one second pulses will have been counted which will represent an average oscillation time of 3.0 seconds.

The number which has been counted is held in the latches 46 and 47 until the end of the next count has taken place. Also, the seven segment displays 49 and 50 indicate the number held by the latches, and therefore the display shows the duration of an average oscillation period. Consequently, the driller can tell at a glance that oscillations have been occurring and what the average length of time of an individual oscillation was, over the last ten.

FIG. 3 illustrates in greater detail a circuit diagram which corresponds to the circuit illustrated by block diagram showings in FIG. 2. It will be understood by one skilled in the art that in the FIG. 3 circuit illustration the various elements which are indicated may take the form of integrated circuits. Such elements are available as commercial items.

Since some of the elements in FIG. 3 correspond with the elements of the simplified diagram in FIG. 2, the corresponding elements are indicated using the same reference number with prime mark added in the FIG. 3 showing. Thus, referring to FIG. 3, there is an input circuit 21' that goes to an amplifier 22', and via a pair of capacitors 25' to the low pass active filter 26'. It may be noted that the capacitors 25' and a capacitor 56 act to remove the DC from the input signal.

The low pass filter 26' has the circuit elements arranged for obtaining the desired action so asto pass only signals having a frequency below a predetermined amount. In the preferred case illustrated, such maximum frequency is 1.0 hertz. The output from the filter 26' goes to an amplifier 27', the output of which goes to an input of the zero crossing detector 30'. Output pulses from the zero crossing detector 30' go to the divide by ten counter 31' that has an output via a circuit connection 32' to an input of an integrated circuit element 57. Element 57 is part of the counter and control circuit which was indicated by the block carrying reference number 35 in FIG. 2. There is a similar integrated circuit element 58 that is interconnected with other elements of the FIG. 3 circuit such as a flip-flop 61, and a group of gates 62, plus an inverter 63. The elements of the counter and control circuit block 35 (FIG. 2) also include a pair of binary coded decimal counters 66.

The circuit elements for supplying the timing pulses, in FIG. 3, include a comparator 40' having an input circuit connection 37'. And, output pulses from comparator 40', at a 60 cycle rate, go over a circuit connection 41' to the first of a pair of integrated circuits 67 and 68. These elements 67 and 68, together, make up the divide by sixty counter 42 that was indicated in FIG. 2. Thus, the output pulses from element 68 are carried via a circuit connection 36' to an input of the pair of counters 66.

It will be appreciated that counters 66 apply output signals over the indicated four circuit connections for each digit which go to each of the latches 46' and 47'. These latches are integrated circuit elements which are effective to receive binary coded decimal signals on the four circuit connections from each of the units and tens counters within the counter 66, so as to then encode these signals so as to provide outputs over the indicated group of inverters 71, in order to actuate the corresponding seven segment elements of the displays 49' and 50'.

It may be noted that the overrange detector 53 (indicated in FIG. 2) is incorporated into the elements of FIG. 3 which include the flip-flop 61. This acts so that when the counters 66 reach the number 100, there will be an output from the tens counter portion as it goes from nine to zero. That output then will act in conjunction with the flip-flop 61 and the various reset circuits to reset the counters and the indicators so that the determination of oscillation signal duration, may begin again.

It will be noted that a system according to this invention provides the benefit of having a frequency meter type of output which provides an indication numerically of the duration, i.e. frequency of oscillations, for an average of ten such oscillations, as the drilling proceeds. This has the advantage over a recording of the oscillation signals that the driller or foreman need not time the oscillations as they were recorded and then figure out the duration thereof, which is a time consuming and not always the most accurate process.

As explained above, the system is designed to display the average time duration for ten cycles of the torque oscillations. If the period should become greater than 10 seconds the display will be blanked except for the decimal point indication, until ten cycles of the torque signal have occurred. At the latter occurrence, the 0.0 display will appear at the display elements 49 and 50, and the count will commence for making the average time display following 10 cycles thereafter.

While a particular embodiment of the invention in accordance with the applicable statutes has been described above in considerable detail, this is not to be taken as in any way limiting the invention but merely as being descriptive thereof.

We claim:

1. In a rotary drilling system including a torque meter for measuring dynamic torque while drilling, in combination first circuit means for detecting oscillations in said dynamic torque comprising a low pass filter and a zero crossing detector, second circuit means for producing periodic timing pulses, and means for indicating the time period of said oscillations comprising means for counting said timing pulses during a predetermined number of said oscillations in order to provide a display which indicates the cause of said oscillations.

2. A combination according to claim 1, said combination further comprising means for dividing by a predetermined number of the outputs from said zero crossing detector in order to average the time period of said oscillations.

3. A combination according to claim 2, wherein said indicating means further comprises means for displaying the number of said timing pulses counted.

4. A combination according to claim 3, wherein said periodic timing pulses are at one second intervals.

5. A combination according to claim 4, wherein said low pass filter passes up to one hertz, and said means for dividing comprises a divide-by-ten counter.

6. A combination according to claim 5, wherein said means for counting timing pulses comprises a pair of binary-coded-decimal counters for determining in tenths and seconds the average time period of said oscillations.

7. A combination according to claim 6, wherein said means for displaying the number of timing pulses comprises seven-segment display means for each of said pair of counters.

8. In a rotary drilling system including a torque meter for measuring dynamic torque while drilling, in combination a low pass filter passing up to one hertz, a zero crossing detector for indicating oscillations in said dynamic torque, a divide-by-ten counter for dividing the number of outputs from said zero crossing detector in order to average the time period of ten of said oscillations, means for producing periodic timing pulses at one second intervals, a pair of binary coded decimal counters for counting by units and tens the number of said one second pulses between outputs from said divide-by-ten counter, a pair of seven-segment display means for said units and tens counters, and circuit means including latches for actuating said display means when said number of one second pulses between outputs from said divide-by-ten counter has averaged the said ten oscillations.

* * * * *